US008109140B2

(12) United States Patent
Tustin et al.

(10) Patent No.: US 8,109,140 B2
(45) Date of Patent: Feb. 7, 2012

(54) DOWNHOLE SAMPLING APPARATUS AND METHOD FOR USING SAME

(75) Inventors: Gary John Tustin, Sawston (GB); Ahmed Hammami, Edmonton (CA); Shawn David Taylor, Edmonton (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 783 days.

(21) Appl. No.: 12/091,868

(22) PCT Filed: Aug. 18, 2006

(86) PCT No.: PCT/GB2006/003092

§ 371 (c)(1),
(2), (4) Date: Oct. 16, 2008

(87) PCT Pub. No.: WO2007/048991

PCT Pub. Date: May 3, 2007

(65) Prior Publication Data

US 2009/0314077 A1 Dec. 24, 2009

(30) Foreign Application Priority Data

Oct. 26, 2005 (GB) ..... 0521774.0

(51) Int. Cl.
*E21B 49/10* (2006.01)

(52) U.S. Cl. ..... 73/152.24

(58) Field of Classification Search ..... 73/152.12, 73/152.13, 152.17, 152.23–152.28
See application file for complete search history.

(56) References Cited

U.S. PATENT DOCUMENTS

| | | | | |
|---|---|---|---|---|
| 3,611,799 | A | 10/1971 | Davis | |
| 3,981,187 | A * | 9/1976 | Howell | 73/152.13 |
| 4,127,169 | A * | 11/1978 | Tubin et al. | 166/250.01 |
| 4,416,152 | A | 11/1983 | Wilson | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,082,054 | A | 1/1992 | Kiamanesh | |
| 5,303,775 | A | 4/1994 | Michaels et al. | |
| 5,377,755 | A | 1/1995 | Michaels et al. | |
| 5,829,520 | A * | 11/1998 | Johnson | 166/250.01 |
| 5,934,374 | A | 8/1999 | Hrametz et al. | |
| 6,178,815 | B1 | 1/2001 | Felling et al. | |
| 6,223,822 | B1 | 5/2001 | Jones | |

(Continued)

FOREIGN PATENT DOCUMENTS

WO 9630628 A1 10/1996

(Continued)

OTHER PUBLICATIONS

Abernethy: "Production increase of heavy oils by electromagnetic heating", Journal of Canadian Petroleum Technology, Jul.-Sep. 1976, pp. 91-97.

(Continued)

*Primary Examiner* — John Fitzgerald

(57) ABSTRACT

A reservoir sampling apparatus (20) is described having at least one probe (26) adapted to provide a fluid flow path between a formation and the inner of the apparatus with the flow path being sealed from direct flow of fluids from the borehole annulus with a heating projector (251) adapted to project heat into the formation surrounding the probe and a controller (253) to maintain the temperature in the formation below a threshold value.

12 Claims, 7 Drawing Sheets

U.S. PATENT DOCUMENTS

| | | | | |
|---|---|---|---|---|
| 6,230,557 | B1 | 5/2001 | Ciglenec et al. | |
| 6,269,882 | B1 * | 8/2001 | Wellington et al. | 166/303 |
| 6,301,959 | B1 | 10/2001 | Hrametz et al. | |
| 6,755,246 | B2 * | 6/2004 | Chen et al. | 166/250.01 |
| 6,786,086 | B2 * | 9/2004 | Hashem | 73/152.41 |
| 7,878,243 | B2 * | 2/2011 | Goodwin et al. | 166/264 |
| 2003/0034777 | A1 | 2/2003 | Chen et al. | |
| 2003/0145987 | A1 | 8/2003 | Hashem | |
| 2004/0093937 | A1 | 5/2004 | Hashem | |
| 2004/0188140 | A1 | 9/2004 | Chen et al. | |
| 2005/0006097 | A1 | 1/2005 | Sandberg et al. | |
| 2005/0082057 | A1 | 4/2005 | Newton et al. | |
| 2008/0066534 | A1 * | 3/2008 | Reid et al. | 73/152.11 |
| 2008/0066536 | A1 * | 3/2008 | Goodwin et al. | 73/152.24 |
| 2008/0066904 | A1 * | 3/2008 | Van Hal et al. | 166/250.1 |
| 2008/0078581 | A1 * | 4/2008 | Goodwin et al. | 175/50 |
| 2008/0125973 | A1 * | 5/2008 | Sherwood et al. | 702/11 |
| 2008/0296017 | A1 * | 12/2008 | Sonne et al. | 166/264 |
| 2009/0008079 | A1 * | 1/2009 | Zazovsky et al. | 166/60 |

FOREIGN PATENT DOCUMENTS

| | | | |
|---|---|---|---|
| WO | 9749894 | A1 | 12/1997 |
| WO | 02077613 | A2 | 10/2002 |
| WO | 03016826 | A3 | 2/2003 |
| WO | 03100219 | A1 | 12/2003 |

OTHER PUBLICATIONS

Abu-Khamsin et al: "Reaction kinetics of fuel formation for in-situ combustion", SPE Reservoir Engineering, Nov. 1988, pp. 1308-1316 (SPE 15736 first presented at the 1987 SPE Middle East Oil Show, Bahrain, Mar. 7-10).

Alberta Oil Sands Technology and Research Authority: "The thermodynamic and transport properties of bitumens and heavy oils", AOSTRA Technical Report #2, Jul. 1984, chapter 3, pp. 3-1 to 3-234.

Birrell et al: "Cyclic SAGD-economic implications of manipulating steam injection rates in SAGD projects—re-examination of the Dover Project", Petroleum Society's Canadian International Petroleum Conference, 2003, Calgary, Alberta, Jun. 10-12, 2003, paper 2003-177.

Brealey: "Evaluation of microwave methods for UKCS heavy oil recovery", SHARP IOR eNewsletter, issue 7, Feb. 2004, website: http://ior.senergyltd.com/issue7/rnd/smes/rml/index.htm.

Demiral et al: "Tracking of three-phase fluid saturation by computerized tomography during steam-CO2 injection", Petroleum Society's Canadian International Petroleum Conference, 2003, Calgary, Alberta, Jun. 10-12, 2003, paper 2003-216.

Fanchi: "Feasibility of reservoir heating by electromagnetic irradiation", 65th Annual Technical Conference and Exhibition of the Society of Petroleum Engineers, New Orleans, LA, Sep. 23-26, 1990, pp. 189-200, SPE 20483.

Kasevich et al: "Pilot testing of a radio frequency heating system for enhanced oil recovery from diatomaceous earth", SPE 69th Annual Technical Conference and Exhibition, New Orleans, LA, Sep. 25-28, 1994, SPE 28619.

Marin et al: "Determination of enthalpy-temperature curves of phase change materials with the temperature-history method: improvement to temperature dependent properties", Measurement Science and Technology, vol. 14, 2003, pp. 184-189.

Ovalles et al: "Opportunities of downhole dielectric heating in Venzuela: three case studies involving medium, heavy and extra-heavy crude oil reservoirs", 2002 SPE International Thermal Operations and Heavy Oil Symposium and International Horizontal Well Technology Conference, Calgary, Alberta, Nov. 4-7, 2002, SPE 78980.

Petrobank Energy and Resources Ltd: "Whitesands project", Whitesands pilot field study, website: http://www.petrobank.com/hea-whitesandsproject.html, Oct. 2008.

Sresty et al: "Recovery of bitumen from tar sand deposits with the radio frequency process", SPE Reservoir Engineering, Jan. 1986, pp. 85-94 (original paper—SPE 10229—presented at the 1981 SPE Annual Technical Conference and Exhibition, San Antonio, Oct. 5-7).

Vieira et al: "Ultraviolet spectrophotometric evaluation of corn oil oxidative stability during microwave heating and oven test", Journal of Agricultural and Food Chemistry, vol. 47, 1999, pp. 2203-2206.

Yazdani et al: "Effect of drainage height and grain size on the convective dispersion in the vapex process: experimental study", 2004 SPE/DOE Fourteenth Symposium on Improved Oil Recovery, Tulsa, Oklahoma, Apr. 17-21, 2004, SPE 89409.

Yortsos: "Distribution of fluid phases within the steam zone in steam-injection processes", Society of Petroleum Engineers Journal, 1984, pp. 458-466 (original manuscript—SPE 11273—accepted for publication Aug. 23, 1983).

* cited by examiner

DOWNHOLE SAMPLING APPARATUS AND METHOD FOR USING SAME

This invention relates generally to the evaluation of a formation penetrated by a wellbore. More particularly, this invention relates to downhole sampling tools capable of collecting samples of fluid from a subterranean formation.

CROSS-REFERENCE TO RELATED APPLICATIONS

This application claims the benefits of priority from:

i) Application Number 0521774.0, entitled "DOWNHOLE SAMPLING APPARATUS AND METHOD FOR USING SAME," filed in the United Kingdom on Oct. 26, 2005; and ii) Application Number PCT/GB2006/003092, entitled "DOWNHOLE SAMPLING APPARATUS AND METHOD FOR USING SAME," filed under the PCT on Aug. 18, 2006;

All of which are commonly assigned to assignee of the present invention and hereby incorporated by reference in their entirety.

BACKGROUND OF THE INVENTION

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a downhole sampling tool, such as the MDT® wireline formation testing tool, owned and provided by Schlumberger, into the wellbore to collect a sample (or multiple samples) of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

Various challenges may arise in the process of obtaining samples of fluid from subsurface formations. Again with reference to the petroleum-related industries, for example, the earth around the borehole from which fluid samples are sought typically contains contaminates, such as filtrate from the mud utilized in drilling the borehole. This material often contaminates the clean or "virgin" fluid contained in the subterranean formation as it is removed from the earth, resulting in fluid that is generally unacceptable for hydrocarbon fluid sampling and/or evaluation. As fluid is drawn into the downhole tool, contaminants from the drilling process and/or surrounding wellbore sometimes enter the tool with fluid from the surrounding formation.

To conduct valid fluid analysis of the formation, the fluid sampled preferably possesses sufficient purity to adequately represent the fluid contained in the formation (ie. "virgin" fluid). In other words, the fluid preferably has a minimal amount of contamination to be sufficiently or acceptably representative of a given formation for valid hydrocarbon sampling and/or evaluation. Because fluid is sampled through the borehole, mudcake, cement and/or other layers, it is difficult to avoid contamination of the fluid sample as it flows from the formation and into a downhole tool during sampling.

Various methods and devices have been proposed for obtaining subsurface fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 have developed certain probes and related techniques to improve sampling. Other techniques have been developed to separate virgin fluids during sampling. For example, U.S. Pat. No. 6,301,959 to Hrametz et al. and discloses a sampling probe with two hydraulic lines to recover formation fluids from two zones in the borehole. Borehole fluids are drawn into a guard zone separate from fluids drawn into a guard zone. In the published international application WO 03/100219 A1 there are disclosed sampling devices using inner and outer probes with a varying ratio of flow area.

Despite such advances in sampling, there remains a need to develop techniques for fluid sampling optimized for heavy oils and bitumens. The high viscosity of such hydrocarbon fluids often presents significant challenges for sampling representative fluids. Effective in-situ reduction of the viscosity of heavy oils without inducing phase and/or compositional changes is thus necessary to obtain a representative sample.

The reduction in the viscosity of heavy oil and bitumen for the purposes of increasing the recovery factor of a reservoir has been a topic of interest in the oil industry for many years. Several methods for the viscosity reduction are known and employed in the field today. It has long been established that heating of heavy oils and bitumens significantly reduce the fluid viscosity and subsequently, increases the fluid mobility. Small thermal changes can result in a relatively large drop in the viscosity of the oil. For example, it is known from AOSTRA Technical Report #2, The Thermodynamic and Transport Properties of Bitumens and Heavy Oils, Alberta Oil Sands Technology and Research Authority, July 1984, that the viscosity of typical Athabasca bitumen from Canada can be reduced by two orders of magnitude by increasing the temperature from 50° C. to 100° C. The plot of FIG. 1 is based on the AOSTRA report. Such a lowering in viscosity will allow for increased mobility of the viscous oil or bitumen required for sampling.

There are many literature examples, both tried and tested along with conceptual, of ways to heat in situ viscous oil in a reservoir to aid recovery. As described below in greater details with reference to examples of known recovery-enhancing techniques, these techniques are generally not immediately suitable for sampling.

Currently, the primary thermal method for heavy oil recovery is steam assisted gravity drainage (SAG-D). This process uses the injection of super-heated steam to improve the mobility of the oil. The process mainly relies on the conduction of heat from the steam to the oil. Efficient transfer of the heat requires intimate mixing of the oil and steam. During the exchange of heat, portions of the steam will be converted to liquid water, often in the form of millimeter or micron sized water droplets suspended in the oil. While it depends on the source of the oil, this process normally results in the formation of stable water-in-oil emulsion. Samples of emulsion containing oils cannot be characterized in a laboratory environment without removal of the emulsion and most demulsification protocols result in irreversible and undesirable changes to the chemical composition of the oil.

An alternative method of reducing the viscosity of the oil has been to use solvents or gases to dilute the oil and thus, form a mixture that has a lower viscosity. Depending on concentration, the dilution of the oil can cause the precipitation of the higher order species from the mixture that can also aid viscosity reduction. However, this method of viscosity reduction for sampling results in an undesirable change in the composition of the oil that prevents proper characterization of the oils chemical and physical properties.

Methods for in situ heating of oils that will not alter their composition are limited. They can be divided into two categories, Joule (or Ohmic) heating and electromagnetic heating. Ohmic heating relies on the principle of applying an electric current through a resistive element to generate heat. A recent U.S. published patent application, US 2005/0006097 A1, discloses a potential method using a downhole heater whereby variable frequencies could be applied across the resistor in order to modulate and control the heating. This method requires good placement of the heating element within the formation as conduction has to be optimized.

Electromagnetic heating uses high frequency radiation to penetrate the reservoir and heat the formation. Many examples of this type of technology for the recovery of heavy oils have been reported. Abernethy, in: Abernethy, E. R., 'Production increase of heavy oils by electromagnetic heating', Journal of Canadian Petroleum Technology, 1976, 91, has developed a steady state model that indicates the depth of penetration of the radiation and its heating potential for the oil. This parameter is then used to determine the viscosity reduction in the oil and the subsequent improvement in the mobility. Although the model may be quite crude, it does appear to indicate that many forms of electromagnetic heating may be used to locally heat oil for the purposes of sampling. Fanchi in: Fanchi, J. R., 'Feasibility of reservoir heating by electromagnetic radiation', SPE 20438, 1990, 189, devised an algorithm for determining temperature increase of an oil as a result of electromagnetic heating and also describes attempted field implementation of some of these devices.

The use of microwaves and radio frequencies for the heating of in place oil has been extensively studied. Most of the microwave work has been carried out using standard microwave frequencies of 2.45 GHz with variable power input. An evaluation of microwave heating for the heavy oil recovery published as Brealy, N., 'Evaluation of microwave methods for UKCS heavy oil recovery', SHARP IOR newsletter, 2004, 7, indicates that field wide application of this technology may not be economic.

In U.S. Pat. No. 5,082,054 to Kiamanesh there is disclosed a system for reservoir heating that uses tunable microwaves for oil recovery. The data indicates that this process can lead to cracking of the oil and several of the claims made support this observation. This type of heating technology has been used in a field environment for differing viscosities of oil as reported in: Ovalles, C., Fonseca, A., Lara, A., Alvarado, V., Urrechega, K., Ranson, A., and Mendoza, H., 'Opportunities of downhole dielectric heating in Venezuela: Three case studies involving medium, heavy and extra heavy crude oil reservoirs', SPE 78980, 2002. The oil types were medium, heavy and extra heavy and all types responded with increased mobility after irradiation. No mention was made to the composition of these oils and changes induced by the heating process.

Radio frequency heating has been applied to reservoirs containing heavy oils as described in: Kasevich, R. S., Price, S. L., Faust, D. L. and Fontaine, M. F., 'Pilot testing of a radio frequency heating system for enhanced oil recovery from diatomaceous earth', SPE 28619, 1994, and also to aid bitumen recovery from the tar sands. These reports indicate that a positive response, regarding the mobility of the oil, was observed due to irradiation at around 13 MHz. In the first case, 250 Kwatts of power was delivered efficiently in this manner.

In all the above cases, no mention was made regarding the changes in composition of the oil except when upgrading had occurred. High temperatures and irradiation can cause fragmentation and isomerisation of components of the oil. Studies on plant oils have shown unsaturation and heteroatoms are affected by prolonged exposure to microwave sources. This is possibly due to local heating or hot spots within the oil.

The use of heat as a way to improve the characterization of the formation has been proposed in the published US patent application no. 2004/0188140 to S. Chen and D. T. Georgi. The described method proposes the heating the oil to increase the T2 relaxation time of the system. This results in more accurate NMR measurements. No information on the monitoring and control of this process are given.

In the light of the described prior art, which to the extend as it refers to heating methods for and properties of heavy oil is incorporated herein, it remains the need to develop apparatus and methods for the reservoir sampling of reservoir with heavy oil or bitumen content.

SUMMARY OF THE INVENTION

The invention achieves its objects by providing a reservoir sampling apparatus having at least one probe adapted to provide a fluid flow path between a formation and the inner of the apparatus with the flow path being sealed from direct flow of fluids from the borehole annulus, wherein the apparatus includes a heating projector adapted to project heat into the formation surrounding the probe and a controller to limit the temperature rise in the formation below a threshold value.

The apparatus is preferably conveyed into the borehole on either a wireline cable, coiled tubing or production tubing.

The probe includes preferably at least one inner and one outer probe.

Preferably the heating projector includes a heat source based Joule (or Ohmic) heating and/or electromagnetic heating.

In another preferred embodiment, at least one probe is heated. In an even more preferred variant of the invention at least one probe is used to conduct heat from the heat source into the formation.

In yet another preferred embodiment, the apparatus includes a temperature sensor such as thermo couple to monitor the temperature of the sampled fluid and/or an in situ viscometer. In a preferred variant of the invention, signals representative of the temperature of the sampled fluid are fed back into the controller. In another variant of this embodiment the thermometer is located along the flow path outside the inner or body of the sampling apparatus.

In a preferred embodiment of the invention the controller maintains an upper limit for the temperature increase in the formation with the limit being determined using prior knowledge of the properties and or composition of the fluid in the formation. In a preferred embodiment of this variant of the invention the temperature limit is set to avoid a phase separation or "flashing out" of the formation fluid.

These and other features of the invention, preferred embodiments and variants thereof, possible applications and advantages will become appreciated and understood by those skilled in the art from the following detailed description and drawings.

DETAILED DESCRIPTION OF THE INVENTION

Figure 2A:
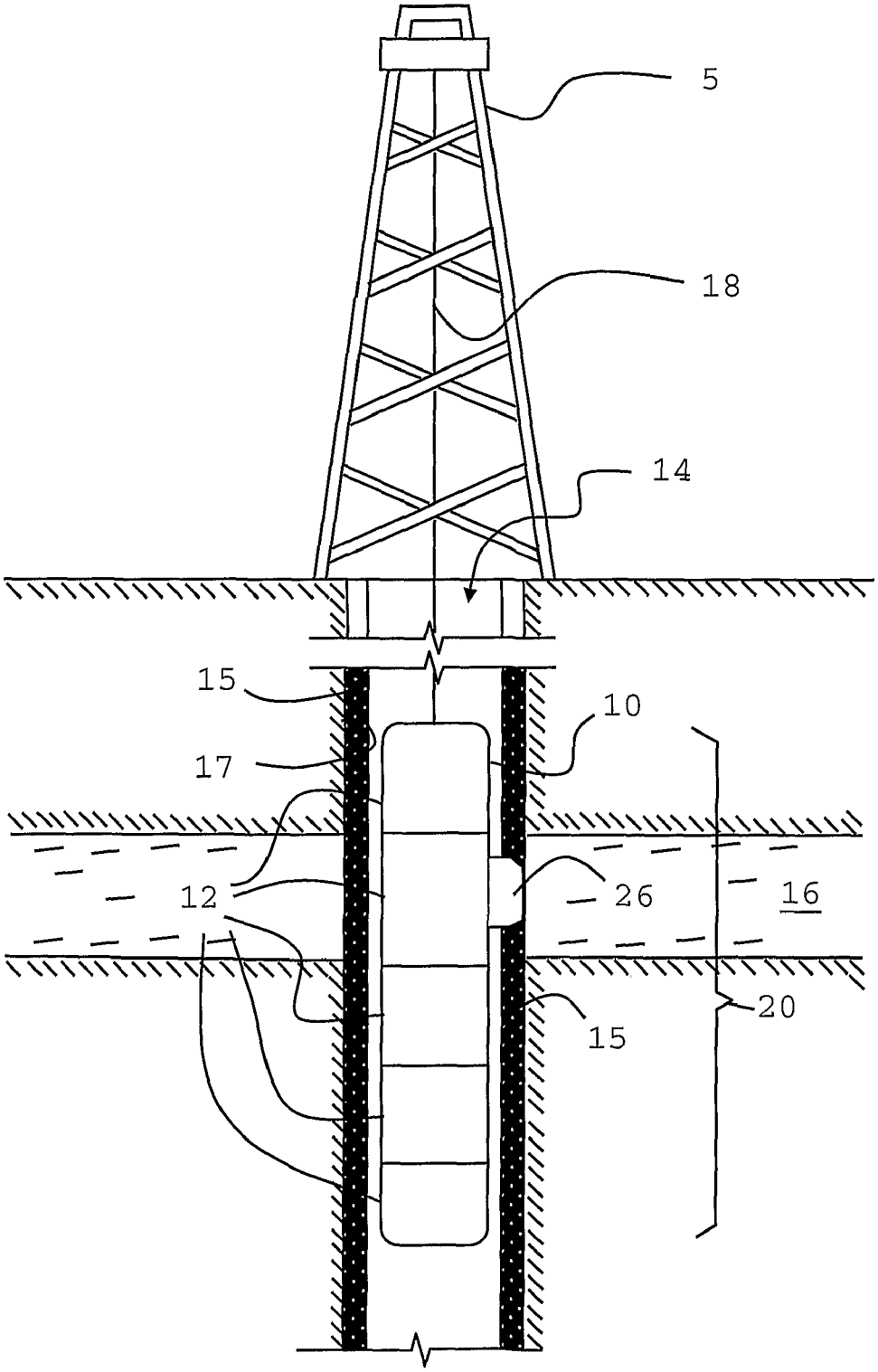
FIGS. 2A and 2B show outline and further details of a formation sampling tool as used in an example of the present invention.

Referring to FIG. 2A, an example environment within which the present invention may be used is shown. In the illustrated example, the present invention is carried by a downhole tool 10. An example commercially available tool 10 is the Modular Formation Dynamics Tester (MDT®) by Schlumberger Corporation, the assignee of the present application and further depicted, for example, in U.S. Pat. Nos. 4,936,139 and 4,860,581 hereby incorporated by reference herein in their entireties.

The downhole tool 10 is deployable into bore hole 14 and suspended therein with a conventional wire line 18, or conductor or conventional tubing or coiled tubing, below a suitable rig 5 or cable feeder as will be appreciated by one of skill in the art. The illustrated tool 10 is provided with various modules and/or components 12, including, but not limited to, a fluid sampling system 20. The fluid sampling system 20 is depicted as having a probe used to establish fluid communication between the downhole tool and the subsurface formation 16. The probe 26 is extendable through the mudcake 15 and to sidewall 17 of the borehole 14 for collecting samples. The samples are drawn into the downhole tool 10 through the probe 26.

While FIG. 2A depicts a modular wireline sampling tool for collecting samples according to the present invention, it will be appreciated by one of skill in the art that such system may be used in any downhole tool. For example, the downhole tool may be a drilling tool including a drill string and a drill bit. The downhole tool may be of a variety of tools, such as a Measurement-While-Drilling (MWD), Logging-While Drilling (LWD), coiled tubing or other downhole system. Additionally, the downhole tool may have alternate configurations, such as modular, unitary, wireline, coiled tubing, autonomous, drilling and other variations of downhole tools.

Figure 2B:
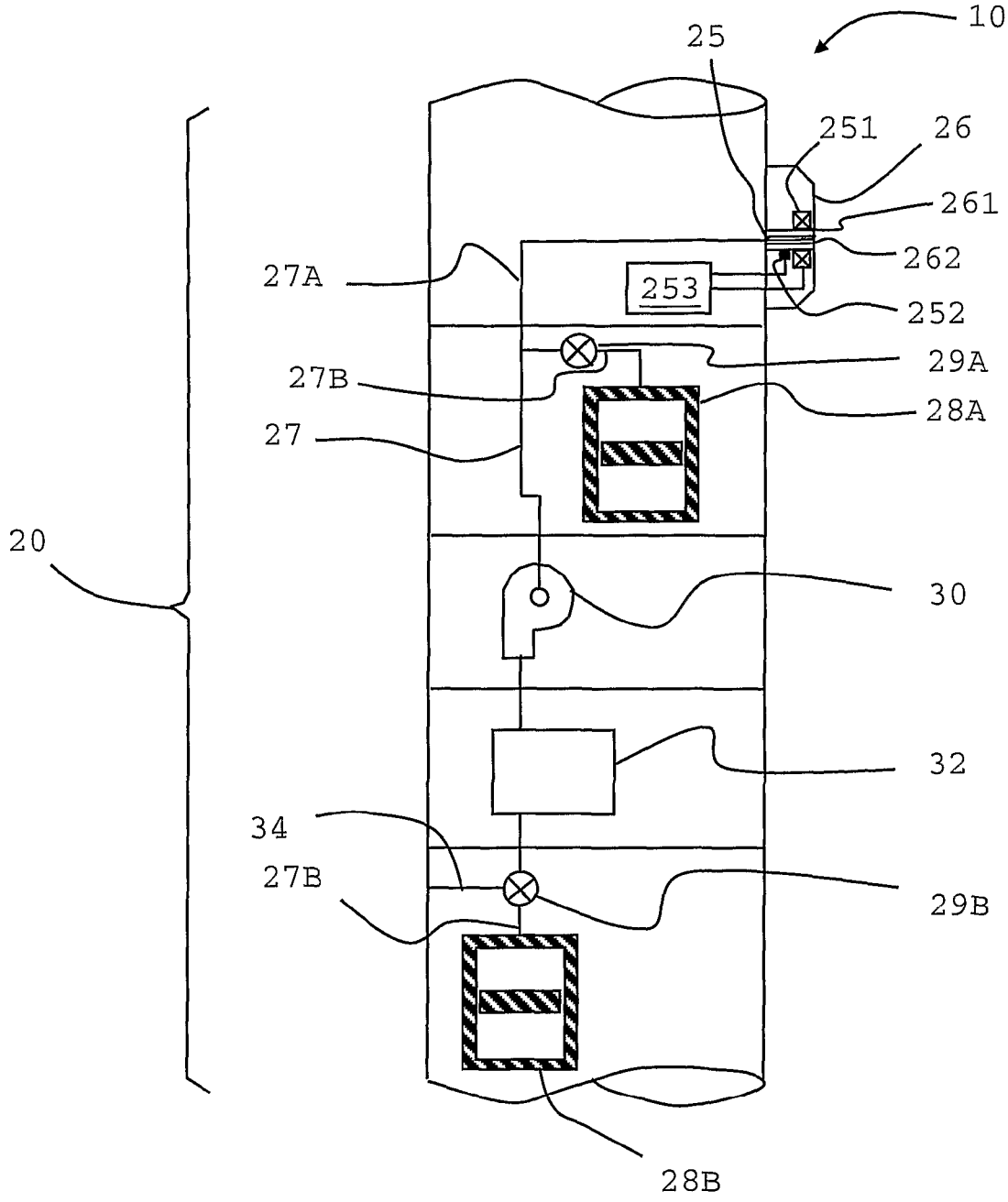

Referring now to FIG. 2B, the fluid sampling system 20 of FIG. 2A is shown in greater detail. The sampling system 20 includes the probe 26, flowline 27, sample chambers 28A and 28B, pump 30 and fluid analyzer 32. The probe 26 as shown include an outer probe 261 and an inner probe 262 connected to an intake 25 in fluid communication with a first portion 27A of flowline 27 for selectively drawing fluid into the downhole tool. The combination of inner and outer guard probes may be based on the adaptable configuration of probes described in WO 03/100219 A1 previously incorporated herein. Alternatively, a single probe or a pair of packers (not shown) may be used in place of the dual probe 26. Examples of a fluid sampling system using probes and packers are depicted in U.S. Pat. Nos. 4,936,139 and 4,860,581, as previously incorporated herein.

The probe further includes a heat projector 251 and a temperature sensor 252. Within the body of the tool there is a temperature controller 253 which is connected to the heat projector 251 and the temperature sensor 252. Under operating conditions, the controller 253 provide a controlled amount of power to the heater 251. The controller 253 and the temperature sensor 252 are connected such that temperature measurements can be used for the accurate control of the heater 251.

Within the tool 10, the flowline 27 connects the intake 25 to the sample chambers, pump and fluid analyzer. Fluid is selectively drawn into the tool through the intake 25 by activating pump 30 to create a pressure differential and draw fluid into the downhole tool. As fluid flows into the tool, fluid is preferably passed from flowline 27, past fluid analyzer 32 and into sample chamber 28B. The flowline 27 has a first portion 27A and a second portions 27B. The first portion extends from the probe through the downhole tool. The second portions 27B connect the first portion to the sample chambers 27B, 28B. Valves, such as valves 29A and 29B are provided to selectively permit fluid to flow into the sample chambers 27B, 28B. Additional valves, restrictors or other flow control devices may be used as desired.

As the fluid passes by fluid analyzer 32, the fluid analyzer is capable of detecting fluid content, contamination, optical density, gas oil ratio and other parameters. The fluid analyzer may be, for example, a fluid monitor such as the one described in U.S. Pat. No. 6,178,815 to Felling et al. and/or U.S. Pat. No. 4,994,671 to Safinya et al., both of which are hereby incorporated by reference.

The fluid is collected in one or more sample chambers 28B for separation therein. Once separation is achieved, portions of the separated fluid may either be pumped out of the sample chamber via a dump flowline 34, or transferred into a sample chamber 28A for retrieval at the surface as will be described more fully herein. Collected fluid may also remain in sample chamber 28B if desired.

The process of the known MDT is optimized for obtaining samples of light and conventional oils. Oils with a viscosity higher than 30 cP present problems as these oils have low mobility. The most mobile fluids in the reservoir will be water and the drilling fluid. In case of a probe 26 having an inner or sample probe 261 and an outer or guard probe 262, the outer probe is designed to aid sampling in the MDT with reduced oil based mud (OBM) contamination. The mobility contrast between the oil and the drilling fluid has to be low for the outer probe 261 to divert the flow of drilling fluids from the intake 25. When the drilling fluid is highly mobile it narrows the volume from which clean formation fluid can be sampled. This narrowing of the sampled volume at increase viscosity contrast is schematically shown in FIG. 3.

Figure 3A:
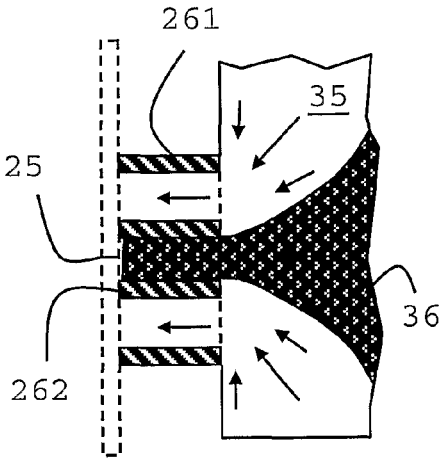
FIGS. 3A and 3B illustrate the effect of heavy oil on conventional sampling devices.
Figure 3B:
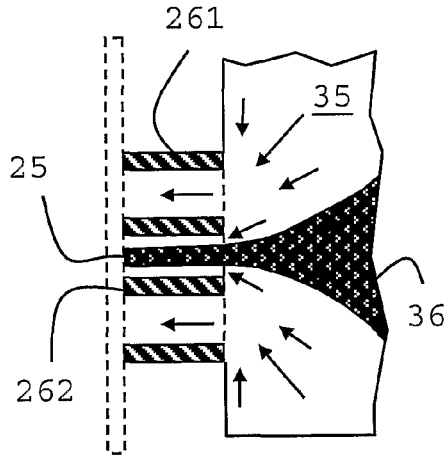

In FIG. 3A, the mobility contrast between the drilling mud 35 and the formation fluid 36 is assumed low resulting in broad flow of formation fluid 36 entering the inner probe 262. At a high mobility contrast (FIG. 3B) with the drilling mud assumed to be more mobile that the formation fluid (heavy oil) the flow of uncontaminated fluid narrows and drilling fluid is drawn into both the annulus of the guard probe 261 and sample probe 262. As a consequence, the sampling time for obtaining uncontaminated sample increases with an increased risk that the tool gets stuck or no satisfactory sample is obtained.

According to the invention the sampling of the low mobility formation fluid is enabled or enhanced through the heating system 251-253 that is designed to least partially heat the formation surrounding the probe 26 of the downhole tool 10. The heating is monitored to ensure the mobility of the oil is increased sufficiently so that it can be sampled but not such that the chemical composition or physical state of the oil altered.

Figure 4:
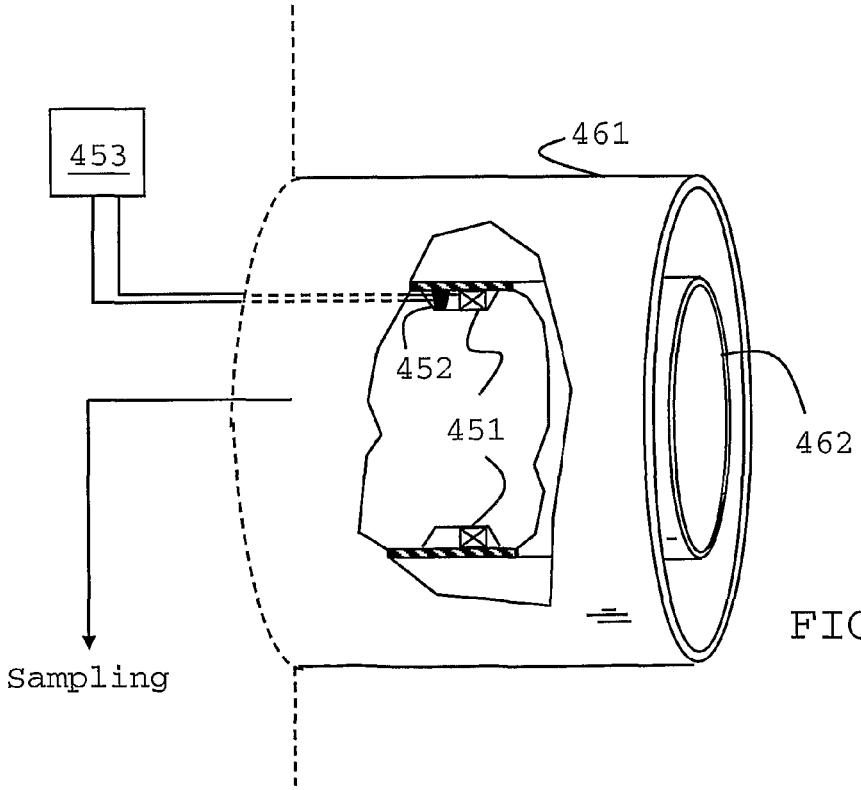
FIG. 4 shows details of a fluid sampling device in accordance with an example of the present invention.

A preferred variant of the tool shown in FIG. 2 is schematically shown in FIG. 4.

In FIG. 4, the heat source or projector 451 is installed as part of the wall of the sample or inner probe 462 such that a high amount of heat is transferred into the formation. Also integrated into the wall is a thermocouple 452 to monitor the temperature of the formation fluid. More relevant parameters such as viscosity may be used to characterize the heated formation fluid. If it is desired to determine the viscosity of the fluid the thermocouple may be replaced by combined with a viscometer (not shown) providing data to the control unit 453 which controls the operation of the heater 451.

Whilst the optimum location of the heat source in the probe is a matter of design depending on the nature of the source, i.e. whether it is electric or radiation based, the length of the probe and other considerations. It may also be located within the body of the tool if it is desired to heat a larger portion of the surrounding formation. The reservoir fluids can be heated using either electromagnetic radiation (Gamma-rays, X-rays, UV, IR, microwaves and radio frequencies) or joule heating or a combination of both. In the example the heat source 441 is a microwave source incorporated into the outer probe.

It is advantageous to also monitor the pressure profile during the operation for example through an solid state or MEMS type pressure sensor (not shown) co-located with the temperature sensor 452 to record a complete profile of the sampling procedure. After being heated and guided into the sampling tool, the sampled fluid is analyzed and either rejected or pumped into a sampling chamber following the procedures described referring to FIG. 2. above.

During the sampling process, the controlled heating is continued until the sample has mobility such that it can be collected.

The rise in temperature of the fluids in the formation is monitored using the temperature sensor 452. When the sensor indicates that the desired temperature has been reach the sample is removed using the guarded probe 461, 462. The inner probe 462 is heated to ensure continual flow of fluids during the extraction procedure. This aspect of flow assurance is important to ensure the sample is taken in good time and is representative of the fluids in the reservoir.

Figure 1:
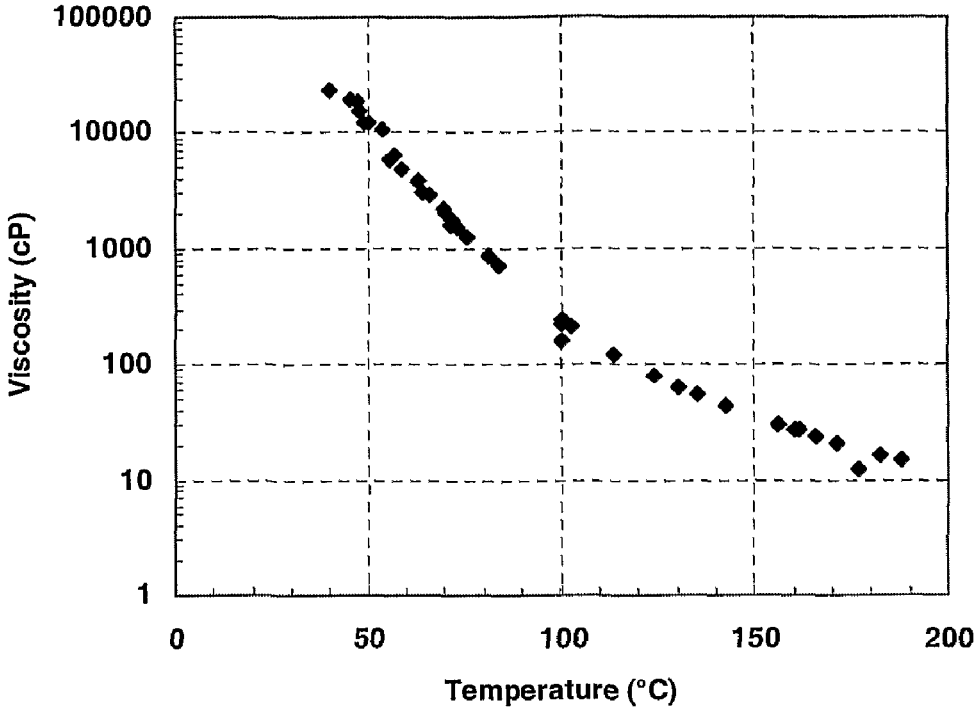
FIG. 1 (Prior Art)
FIG. 1 shows the viscosity (logarithmic scale) of typical Athabasca bitumen from Canada with temperature (linear scale)
Figure 5:
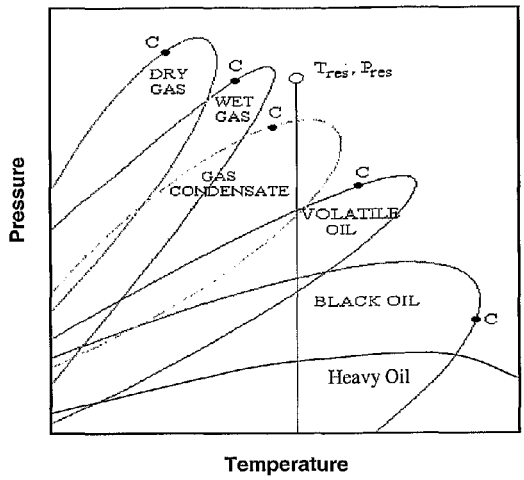
FIG. 5 (Prior Art)
FIG. 5 illustrates the limits of effective temperature control.
Figure 6:
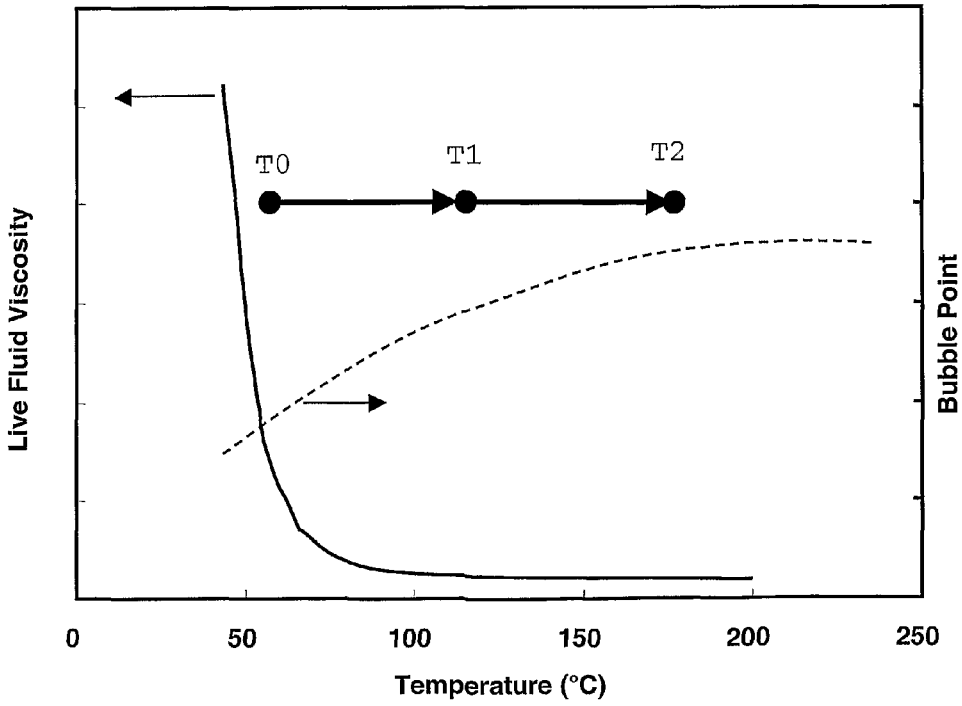
FIG. 6 shows a schematic pressure-temperature diagram showing the typical saturation curves for different types of hydrocarbon fluids with C denotes critical point of the respective fluid.

The desired temperature is set using formation evaluation performed prior to the sampling. Typically the formation evaluation used is the result of a wireline logging operation. The viscosity of the in situ oil can be for example determined via correlation to the T2 relaxation time gained through NMR logging. With such prior knowledge the required temperature or its maximum can be determined using for example a database of experimental data such as illustrated in FIGS. 1, 5 and 6.

As mentioned earlier, a key requirement of any sampling operation is to obtain a "representative" sample of the hydrocarbon fluid from reservoir. A "representative" sample is an sample whose chemical composition and physical state has not been altered by changes in composition, temperature, and pressure. Ideally, the reservoir fluid to be sampled exists as a single phase fluid within the reservoir, when the pressure of the reservoir is above the saturation pressure of the fluid (i.e. bubble point or dew point). FIG. 5 is a schematic pressure-temperature plot showing the saturation curves for various types of hydrocarbon fluids, including dry gas, wet gas, condensate, volatile oil, black oil, and heavy oil.

During the sampling process, the fluid must be withdrawn from the reservoir, through the sampling probe (guard probe or otherwise), and into the sample storage chamber within the sampling tool (e.g., MDT). As such, a decreasing pressure gradient must be created from the reservoir to the storage chamber that will induce the oil to flow into the chamber. Key to this process is preventing the pressure from dropping below the saturation curve and thus, causing the fluid to flash into a mixture of gas and liquid. The presence of the two phases however makes it difficult to obtain a representative sample.

Preventing a flash requires the isothermal pressure drop due to sampling to be less than the difference between the reservoir pressure and saturation pressure. With the exception of heavy oil, the viscosity of the hydrocarbons fluids is relatively low and thus, the magnitude of the pressure drop can be easily controlled through the flow rate. However, the high viscosity of the heavy oil and bitumen leads to large pressure drops during sampling using existing technology and, in turn, greatly increases the risk of flashing the oil. The slow sampling flow rates required to reduce this risk increases the chance of having the tool stuck in the well. Also, the slow sampling flow rates do not prevent significant contamination of the sample due to the low mobility of the heavy oil relative to the drilling mud and formation water.

The heated sampling probe (guarded or otherwise) can provide a means of reducing viscosity, reducing the drawdown pressure, and reducing contamination by improving the mobility of the heavy oil relative to the drilling mud and formation water. As illustrated in FIG. 6, heating the formation in a controlled manner, the fluid can be heated from an initial reservoir temperature T0 to a temperature T1 at which the viscosity at pressure (solid curve) is greatly reduced and yet the difference between the reservoir pressure and saturation pressure is sufficient to allow enough drawdown pressure to sample the heavy oil at a relatively fast flow rate. Temperature control is used to maintain the temperature at around T1 thus avoiding temperatures T2 too close to the bubble point curve (dashed line).

The monitoring and control of the heating process is therefore an important aspect of the present invention. Over heating of the fluid can have two main detrimental effects: It may cause thermal degradation or cracking to occur, which will alter the composition of the oil and thus produce a non-representative sample or it may push the fluid to a pressure and temperature condition that is too close to the saturation curve of the fluid. Thus, the drawdown pressure required to sample the fluid will cause an undesirable flash of the fluid resulting in uncontrolled two phase flow into the sampling chamber.

Thus, the heated sampling probed being described will heat the formation in a controlled fashion that is monitored to ensure overheating of the fluid does not occur. Heating of the fluid will reduce the viscosity of the oil, allowing for lower drawdown pressures during sampling and faster sampling flow rates. The benefit is the ability to obtain a representative sample of heavy oil bitumen that has not been altered in its chemical composition due to significant contamination, reaction, or otherwise nor has its physical state been altered from single phase fluid to two phase fluid or otherwise.

Figure 7:
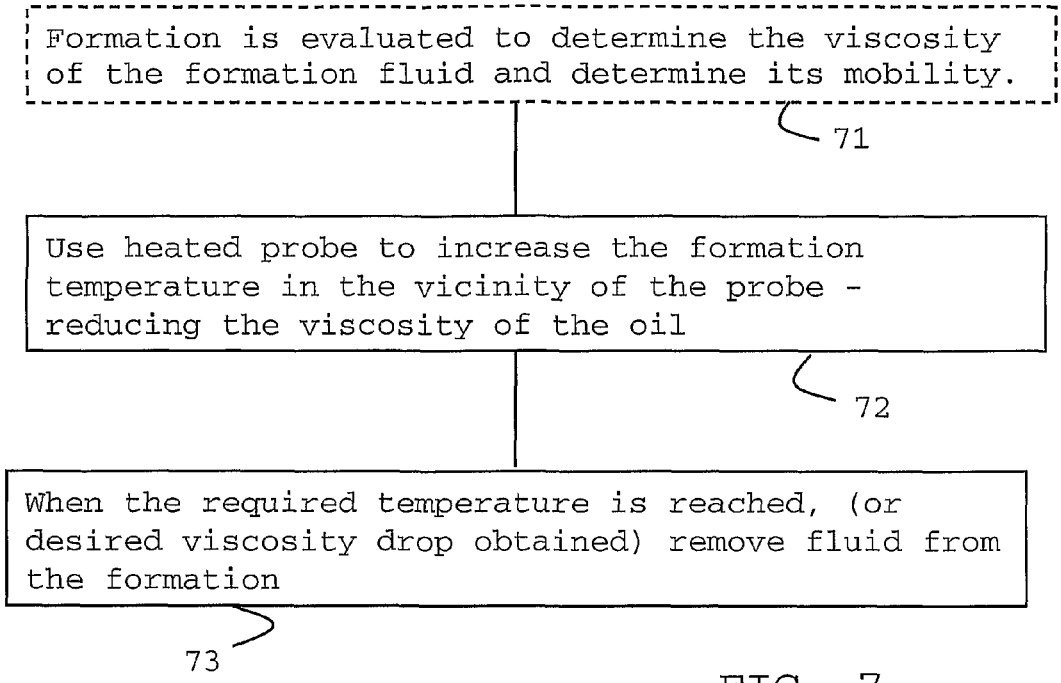
FIG. 7 shows steps in accordance with an example of the invention.

In general the present invention proposed a method having three principal stages as illustrated in FIG. 7.

Stage 1 (71): In this preferred but not necessary step, the formation is first evaluated to determine the viscosity of the in place oil and determine its mobility. This is done using NMR or other suitable techniques such as acoustic monitoring. When the formation has been evaluated the required viscosity reduction and/or raise in temperature needed to generate good samples will be determined. This is done by comparison to prior data and use of tables and logs. The effective amount of heating needed will be determined by the use of data such as that in figure three. Heating the oil in the case shown to 120° C. will give a highly mobile fluid. If the fluid were to be heated to higher temperatures, no further significant drop in viscosity would be seen but the fluid would approach the phase change boundary. This shows that further heating of the oil is of little value and potentially detrimental to the sampling process; thereby validating the importance of the initial logging and evaluation process in this procedure.

Stage 2 (72): A thermally heated guard probe will be used to increase the formation temperature in the vicinity of the probe, hence reducing the viscosity of the oil while diverting the mud flow to the outside of the sampling chamber, where required. This can be used in conjunction with other forms of heating, such as combinations of electromagnetic radiation, which will heat the oil deeper in the formation. The probe will act as a wave guide to direct the electromagnetic waves to the desired part of the formation, hence maximizing the efficiency of the process. This changes in temperature and/or viscosity of the oil will be monitored by techniques such as acoustic or IR monitoring, NMR logging (changes in t2 relaxation times) or a thermocouple placed in the formation and/or a combination thereof.

Stage 3 (73): When the required temperature is reached, (or desired viscosity drop obtained), the fluid is subsequently removed from the formation by use of a pump. The fluid will flow along the heated guard probe, the heat in the probe is now essential to maintain the flow of the oil and ensure the entire sample is delivered into the sampling chamber or vessel.

Within the guard probe, thermocouples, thermal switches and/or similar mechanisms, are to be used to monitor the temperature of the oil to ensure good flow assurance. The viscosity of the fluid entering the guard probe and that leaving it can also be monitored to check the performance of the procedure.

When the entire fluid sample required has been deposited in the sampling vessel, the vessel is sealed and can be allowed to cool as the sample has been obtained.

This technique can use many different ways of heating the formation, and combinations thereof, which give a uniform heating deep into the reservoir. The preferred combination of thermal heating and tunable microwaves allows near, medium and deep heating into the reservoir and the energy used will control the heat up rate and final temperature of the reservoir fluid.

In effect, the heated probe has dual functionality. It participates in the heating of the reservoir fluids in the first part of the procedure, it simultaneously ensures sampling of the reservoir fluid will be collected in a timely manner (whilst the fluid is still warm) and with minimal (if not zero) contamination. It is also instrumented such that key parameters such as viscosity and temperature are monitored during the operation.

Figure 8A:
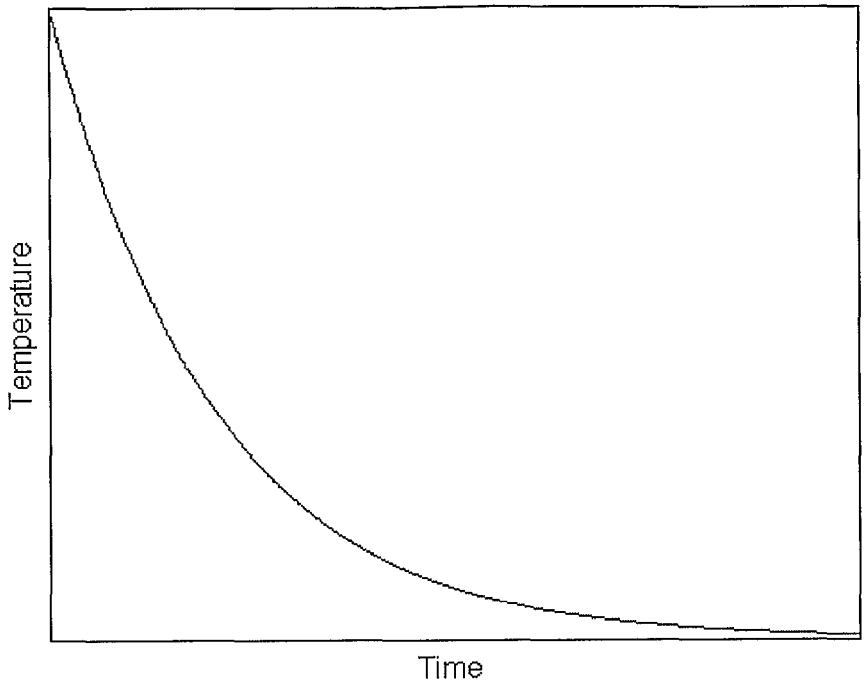
FIG. 8 illustrates a phase change effect exploited in a variant of the present invention.
Figure 8B:
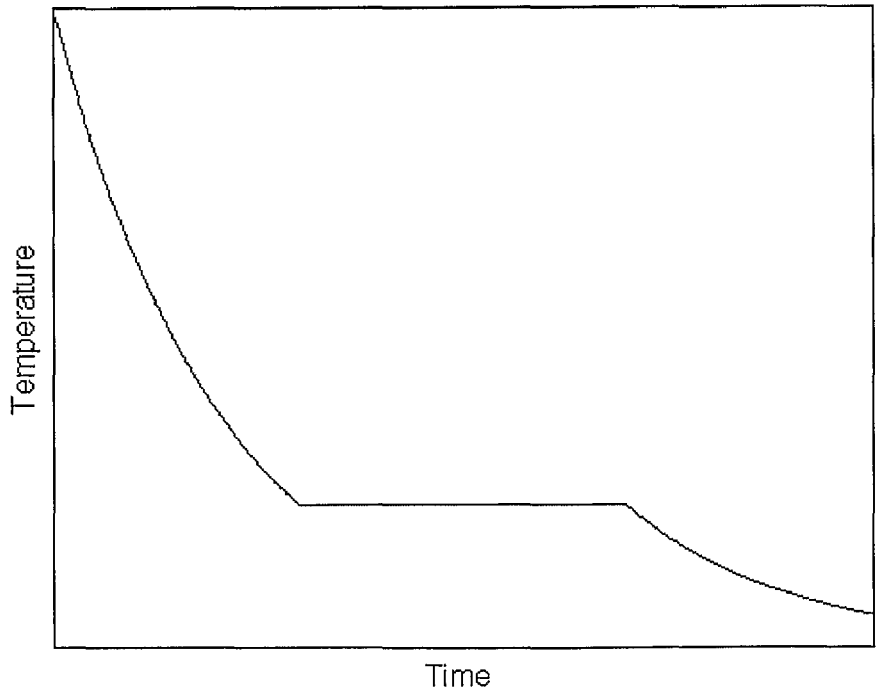

In a variant, the probe itself may contain thermosetting 'phase change' materials, such as waxes or thermoplastics, which will maintain the temperature of the probe, particularly when the heating facility is not operational. This will allow the probe to be moved from location to location without large losses of heat and hence, reduce sampling time and minimize the potential for the tool to become stuck in the highly viscous formation. FIG. 8A shows the cooling curve of a typical material with no phase change. The exponential heat loss is significantly different from the behavior shown by phase change materials depicted in FIG. 8B.

Various embodiments and applications of the invention have been described. The descriptions are intended to be illustrative of the present invention. It will be apparent to those skilled in the art that modifications may be made to the invention as described without departing from the scope of the claims set out below.

The invention claimed is:

1. A reservoir sampling apparatus having at least one probe adapted to provide a fluid flow path between a formation and the inner of the apparatus with the flow path being sealed from direct flow of fluids from the borehole annulus, wherein the apparatus includes a heating projector adapted to project heat into the formation surrounding the probe and a controller to maintain the temperature of the fluid in the formation below a threshold value, and wherein the controller is adapted to maintain the temperature of the heated formation fluid below an upper limit and the upper limit is determined using prior knowledge of the properties and/or composition of the fluid in the formation.

2. The apparatus of claim 1 conveyed into the borehole on either a wireline cable, coiled tubing or production tubing.

3. The apparatus of claim 1 wherein the probe includes at least one inner and one outer probe.

4. The apparatus of claim 1 wherein the heating projector includes a heat source using Joule (or Ohmic) heating and/or electromagnetic heating.

5. The apparatus of claim 1 wherein the heat source heats at least parts of the probe.

6. The apparatus of claim 1 wherein the controller is adapted to maintain the temperature of the heated formation fluid below an upper limit set to avoid a phase separation or "flashing out" of the formation fluid.

7. The apparatus of claim 1 including a viscometer to monitor the viscosity of sampled fluid.

8. The apparatus of claim 7 including a signal path between the controller and the viscometer.

9. The apparatus of claim 1 including a temperature sensor to monitor the temperature of sampled fluid.

10. The apparatus of claim 9 including a temperature sensor to monitor the temperature of the sampled fluid close or within the formation.

11. The apparatus of claim 9 including a signal path between the controller and the temperature sensor.

12. A method of sampling formation fluid from a downhole location, including the steps of:

lowering a sampling tool with a probe into a wellbore;

using a heat projector to increase the formation temperature in the vicinity of the probe to reduce the viscosity of the formation fluid;

controlling the temperature to avoid or reduce changes in the composition of the formation fluid;

sampling the fluid into the sampling tool by providing a fluid flow path between a formation and the inner of the apparatus with the flow path being sealed from direct flow of fluids from the borehole annulus; and using prior knowledge of the formation or formation fluid to control the temperature.

* * * * *